US005577366A

United States Patent [19]

Higgins

[11] Patent Number: 5,577,366

[45] Date of Patent: Nov. 26, 1996

[54] METHOD OF WRAPPING ELONGATE ARTICLES AND PRODUCT MADE

[75] Inventor: Peter Higgins, Warwickshire, United Kingdom

[73] Assignee: Carrs Paper Limited, West Midlands, United Kingdom

[21] Appl. No.: 428,226

[22] PCT Filed: Oct. 29, 1993

[86] PCT No.: PCT/GB93/02229

§ 371 Date: May 1, 1995

§ 102(e) Date: May 1, 1995

[87] PCT Pub. No.: WO94/10042

PCT Pub. Date: May 11, 1994

[30] Foreign Application Priority Data

Oct. 29, 1992 [GB] United Kingdom ..... 9222744

[51] Int. Cl.[6] ..... B65B 13/02; B65B 61/18; B65D 65/34

[52] U.S. Cl. ..... 53/399; 53/412; 206/443; 229/87.05

[58] Field of Search ..... 53/399, 412, 133.5, 53/588; 206/446, 493; 229/87.05

[56] References Cited

U.S. PATENT DOCUMENTS

| | | | |
|---|---|---|---|
| 1,156,080 | 10/1915 | Hopkinson | 229/87.05 X |
| 1,870,519 | 8/1932 | Legvillon | 53/412 X |
| 1,993,538 | 1/1939 | Kahn | 229/87.05 |
| 3,055,163 | 9/1962 | Ramseler | 229/87.05 X |
| 3,092,251 | 6/1963 | Jaggers | 229/87.05 X |
| 4,187,137 | 2/1980 | Beauchamp . | |
| 4,655,028 | 4/1987 | Silbernagel . | |
| 4,729,205 | 3/1988 | Silbernagel | 53/133.5 |

FOREIGN PATENT DOCUMENTS

| | | |
|---|---|---|
| 0142904 | 5/1985 | European Pat. Off. . |
| 0149227 | 7/1985 | European Pat. Off. . |
| 1275886 | 12/1961 | France . |
| 2395898 | 1/1979 | France . |
| 2152910 | 5/1972 | Germany . |
| 756199 | 8/1956 | United Kingdom . |
| 1368063 | 9/1979 | United Kingdom . |

*Primary Examiner*—Bryon P. Gehman
*Attorney, Agent, or Firm*—Loeb & Loeb LLP

[57] ABSTRACT

An elongate article, such as a bundle B of individual elements A with or without an immediate wrapper, is wrapped by forming thereon a winding 20 composed of a strip of wrapping material, and laying on the article a tear member 15 which extends along substantially the entire length of the article and has an end portion thereof exposed. By pulling the exposed end portion of the tear member away from, and along the length of, the article, the wrapping may be disrupted without the use of cutting tools or the like which may damage the wrapped article.

8 Claims, 1 Drawing Sheet

METHOD OF WRAPPING ELONGATE ARTICLES AND PRODUCT MADE

DESCRIPTION OF THE INVENTION

Figure 1:
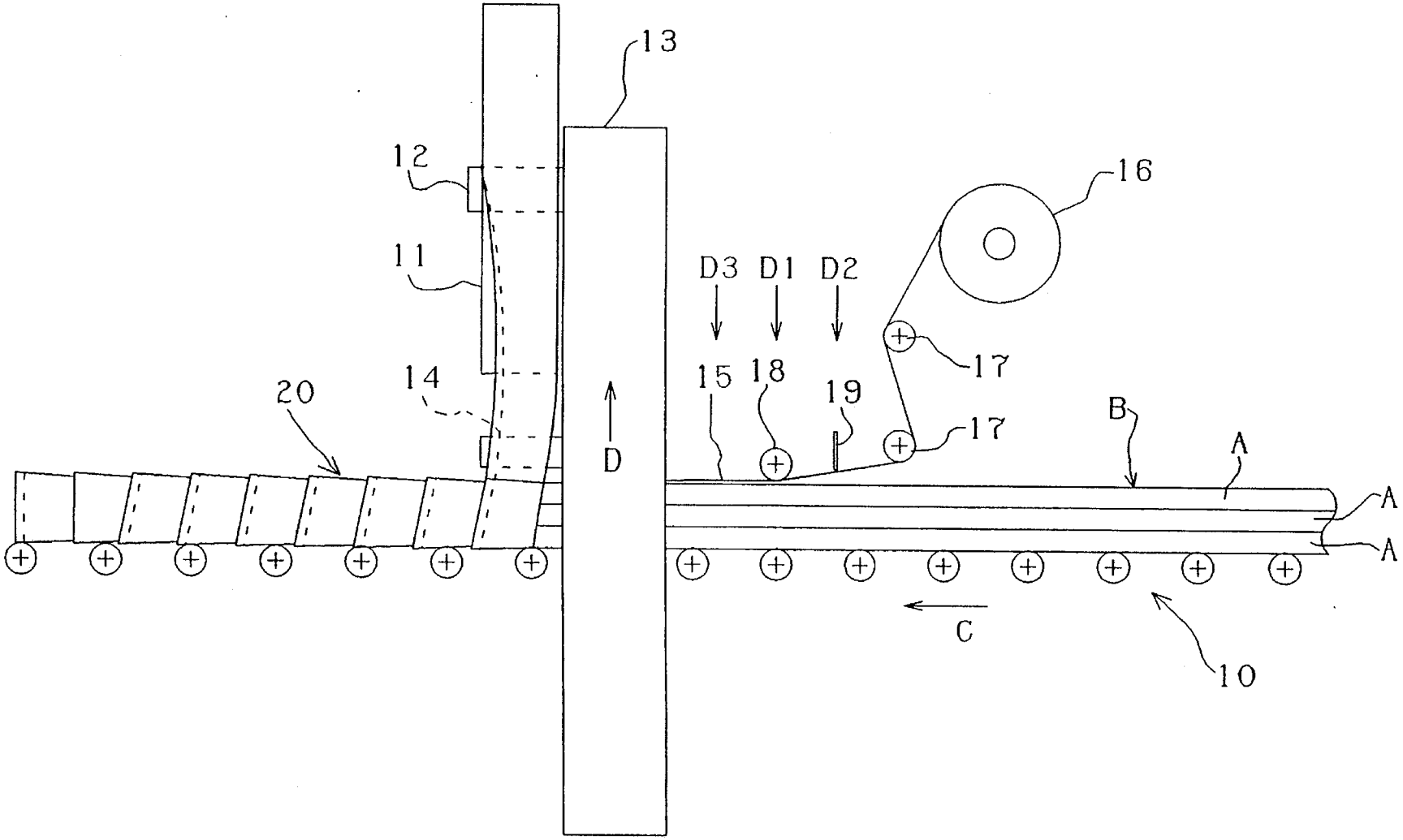

This invention relates generally to any package formed by wrapping articles by strips or narrow widths of material wrapped around those articles and in particular to a method of wrapping elongate articles, such as pipes, rods, tubes and other elements, which may be substantially straight throughout their length, or of curved or other non-linear form, or even in the form of a closed loop, such elements being wrapped either singly or in bundles, and the term "elongate article" as used herein is intended to encompass all such elements either singly or in bundles. The invention also relates to a package comprising an elongate article, as above defined, provided with a wrapping in accordance with the method hereinafter described.

Conventionally, such articles are wrapped by means of one or more strips of paper or the like which are wound helically around them using appropriate machinery, for example as shown in German Patent Specification No. 2256708, so that adjacent windings overlap somewhat and may be adhesively secured together where they overlap, although not necessarily.

A preferred method of wrapping is described in our European Patent Specification No.0388795 whereby the strip of wrapping material is coated on one side only with an adhesive of a kind (usually known as a "cold seal" adhesive) which without the application of heat adheres strongly only to itself, and a longitudinal edge portion of the strip is turned over in such a manner that as the strip is wound around the elongate article being wrapped thereby, that portion of the adhesive coating which is carried by the turned over portion of the strip engages a remaining portion of the adhesive coating carried by a non-turned over portion of the strip on an adjacent turn of the winding.

In order to open the package formed by either of the above methods, it is necessary to cut or rip the wrapping material along substantially the entire length of the wrapped article. However, the use of a cutting tool may damage the wrapped article and although specially designed cutters have been provided which are intended to prevent damage to the wrapped article, these are often lost so that any cutting implement at hand may be used with attendant risk of damage to the wrapped article. Ripping the wrapping material may be difficult and unacceptably slow, and also is not without risk of damage to the wrapped article, at least in some cases.

Accordingly, it is an object of the present invention to provide an improved method of wrapping, particularly elongate articles to facilitate the unwrapping thereof when required.

According to the present invention we provide a method of wrapping an article by forming a winding thereon of at least one strip of flexible wrapping material wound helically around said article so that successive turns of the wrapping material overlap one another, characterised by the step of laying between the wrapping material and the article a longitudinally extending tear member which extends over substantially the entire length of the article with an end portion of the tear member exposed externally of the wrapping and thereby available to be pulled in a direction away from the article so as thereby to tear through the successive turns of the wrapping material and along substantially the entire length of the article.

The invention also resides in a package comprising an article having thereon a wrapping comprising at least one strip of wrapping material wound helically around the article in such a manner that successive turns of the wrapping material overlap one another and are adhesively secured together where they overlap, characterised by a tear member which extends over substantially the entire length of the article with an end portion of the tear member exposed externally of the wrapping and thereby available to be pulled in a direction away from the article so as thereby to tear through the successive turns of the wrapping material and along substantially the entire length of the article.

Preferably, the tear member extends beyond at least one end of the wrapping in order to afford said exposed end portion, which may be formed into a loop or have a pull-ring, toggle or other member attached thereto. Alternatively, the tear member may not extend beyond the end of the article, but be arranged so as to overlie at least one turn of the wrapping material adjacent to the end of the article. If desired, the tear member may be provided with such exposed end portions thereof at both ends of the package so that it can be opened from either end at the convenience of the user.

The wrapping materials which can be employed in accordance with the invention include paper and the like, films and foils of plastics materials, (including shrink and stretch wrapping materials) and also thin metal foils as well as laminates of any such materials which might be creped, corrugated or otherwise converted, coated or treated.

The tear member may be formed from any appropriate material which is capable of rupturing the chosen wrapping material. Where the wrapping material comprises paper, the tear member may be formed of tape or thread, or an appropriate metal strip, or a cord or thread of textile material or the like, made from a low extending material such as polypropylene, polyethylene, nylon, hessian, polyester, or other natural or "man-made" materials or metal(s) or sisal string.

Whilst a length of material constituting the tear member may be laid manually along the length of the article before it is wrapped, preferably the tear member is applied to the article simultaneously with the wrapping process by passing the article successively through a station at which the tear member is applied and a station at which the wrapping is applied.

In some cases, depending on the nature of the article being wrapped, the wrapping material, and the material of which the tear member is made, the tear member may be held in place between the wrapping material and the article by virtue of the tension in the applied wrapping material. However, the tear member may be attached either to the outer face of the article being wrapped or to the inner face of the wrapping material so as to restrain it against lengthwise withdrawal from the package when opening is attempted.

Accordingly, in one case, the tear member may comprise a narrow strip of appropriate material having an adhesive substance on at least one face thereof. Such material may be applied to the article being wrapped, and secured thereto by means of a pressure roller so that as the article is advanced towards the wrapping station, the tear strip is drawn off from a supply thereof by virtue of the advancement of the article during the wrapping process. It will be appreciated that where the articles to be wrapped are of such a nature that such an adhesive might damage or otherwise mark the surface in an unacceptable manner, it would be possible to provide an inner layer of wrapping material in direct contact with the article, so that the tear strip is thereby adhered to the inner layer of wrapping material rather than directly to the article.

In such a case, the inner layer of wrapping material may comprise a winding of a very soft paper which is easily disrupted so that when the tear member is pulled outwardly to open the outer wrapping it also serves to tear open the inner wrapping. Alternatively, the inner wrapping may comprise a pre-formed elongate member which substantially encloses the article whilst being open along its entire length so as to facilitate removal from the article when the outer wrapping has been removed. Such an inner wrapping may be require in many instances to provide additional protection for the article where this comprises relatively soft and easily damaged materials, such as plaster or the like.

Alternatively, such an adhesive strip may be applied to the article with the adhesive-coated face outermost, an initial length of the strip being laid on the leading end of the article as it approaches the wrapping station, so that such initial length of tear member becomes secured to the inner face of at least the first turn of wrapping material applied to the article, whereby the tear member can be drawn onto the remainder of the article as it progresses through the wrapping station.

Instead of relying on adhesive to secure the tear member to the article or to the wrapping material, the tear member may be drawn onto the article by arranging a portion of the tear member to extend across the leading edge of the article so as, at least at the leading end of the article, to lay against two opposed faces thereof. Thus, a length of the tear member may extend across the path of advancement of the article, with its free end held stationary, so that as the article is advanced the tear member will be applied to two opposed faces of the article. Whilst in such a case the tear member could be arranged so as to extend fully along both faces of the article, in practice it is envisaged that it would be sufficient to release the free end of the tear member after the first few turns of the wrapping material have been applied, the wrapping material then being sufficient to hold the tear member in place as the wrapping operation proceeds. Nevertheless, it would be advantageous to provide tear members in this way which extend along generally opposite portions of the package thus formed, so that at least one such tear strip should be easily accessible whatever the orientation of the package when it is required to open same.

In this case, it would be possible to employ non-adhesive tear members, and also tear members in the form of thin filaments, such as nylon or the like, textile threads or metal wires as previously described.

The invention will now be described by way of example with reference to one specific embodiment as illustrated in the accompanying drawing.

As illustrated, in a generally conventional manner elongate elements A are-assembled together into bundles B which are held together, for example by means of rollers (not shown) and advanced through a wrapping station in the direction indicated by arrow C whilst supported by a roller conveyor indicated generally at 10. In some cases the articles may be secured together in the bundle by means of some form of primary fastener such as self-adhesive tape, or plastic or metal strapping, or they may be assembled within an inner wrapping (not shown in the accompanying drawing). Alternatively, a single article may be wrapped.

In the wrapping station, a roll 11 of wrapping material is mounted on a roll holder 12 carried by an annular member 13 which surrounds the bundle B and rotates in the direction of arrow D as the bundle travels axially through the centre of the annular member. Material from the roll 11 is thus wrapped around the bundle B to form a helical winding 20 in which adjacent turns overlap.

In the embodiment as illustrated, one edge of the wrapping material is turned inwardly as it leaves the roll 11 (by means now shown) as indicated at 14 and the in-turned marginal portion is laid onto the opposite marginal portion of the preceding turn of the wrapping, adjacent turns being secured together by means of a cold seal adhesive coating which is carried by one face of the material in the manner more full described in our European Patent Specification No. 0388795 previously referred to.

In accordance with the present invention a tear member 15 is applied between the bundle B and the winding 20. In the illustrated embodiment, the tear member 15 comprises a narrow ribbon of plastics material with an adhesive coating on one face thereof which is drawn from a supply roll 16, over guide rollers 17 and under a pressure roller 18 whereby it is pressed into contact with the upper face of the bundle B so as to adhere thereto as the bundle advances through the wrapping station.

A detector indicated by arrow D1 responds to the leading edge of the bundle B as it approaches the wrapping station to apply downward pressure to the roller 18 thereby pressing the tear member 15 downwardly into contact with the upper face of the bundle B. A detector D2 upstream of the detector D1 is arranged to detect the trailing edge of the bundle and release pressure roller 18, whilst a further detector D3, downstream of the detector D1, is also arranged to detect the trailing edge of the bundle and to operate a cutter 19 at a position upstream of the detector D3 to sever the tear member from the supply.

In this way, a length of the tear member 15 is laid along the entire length of the articles A constituting the bundle B, with an end portion of the tear member extending beyond the trailing end of the bundle. Such end portion of the tear member is not covered by the wrapping 20 and remains available for a user when it is required to remove the wrapping. The end portion of the tear member may be formed into a loop or may have an appropriate ring pull attached thereto to facilitate subsequent opening of the package.

When the exposed portion of the tear member 15 is pulled in a direction generally perpendicularly away from the surface of the bundle B, it tears through successive turns of the wrapping 20 without any possibility of causing damage to the articles A in the bundle B.

The winding 20, whilst split along its length, substantially retains its integrity as a single piece of wrapping, thereby facilitating its collection and disposal.

Whilst in the embodiment as described, one edge of the wrapping material is turned inwardly, the material may alternatively be laid on the bundle without turning over the edge portion. Likewise, whilst the adjacent turns of the wrapping material are adhesively secured together, this may not always be required.

Instead of applying the adhesive-coated face of the tear member directly to the bundle B, an inner wrapping could be interposed between the bundle and the tear member, so that the article being wrapped comprises a bundle of individual elements with an inner wrapper, which is preferably such as to be itself disrupted by the tear member when the wrapping material 20 is subsequently opened. For this purpose, the inner wrapper may be formed as a winding of a soft paper.

Alternatively, the inner wrapper may comprise a relatively rigid length of cardboard or the like folded to encase the bundle by bringing longitudinal edges of such length of cardboard together around the bundle, so that when the wrapping material 20 is removed, the inner wrapper is open along its length for ease of access to the elements making up the bundle. Flexible, corrugated cardboard may also be used for the inner wrapper in a similar manner.

In a further arrangement, the tear member 15 could be applied go the bundle B with its adhesive-coated face outermost so as to adhere to the inner face of the wrapping material 20. Alternatively, the tear member 15 may be non-adhesive. In either case, to draw the tear member from the supply roll 16, a gripper (now shown) may be arranged to pull the free end of the strip downwardly across the path of advancement of the bundle before the latter is fed into the wrapping station so that, with the free end of the tear member held below the conveyor 10 by the gripper, the strip is drawn off the supply roll 16 as the bundle is advanced and laid onto the upper face of the bundle. After at least one turn of wrapping material has been applied to the bundle, the gripper may then be released, the leading end of the strip then being held in position on the bundle by the initial turn of wrapping material.

Although the tear member conveniently comprises a ribbon as previously described, it may be possible to employ a string or cord of natural or artificial fibres, a filament, such as nylon or the like, or a metal wire as previously listed.

Instead of laying the tear member on top of the bundle B it could alternatively be introduced between the bundle and the conveyor, or on both top and bottom sides of the bundle.

Whilst the invention has been illustrated as applied to the wrapping of a bundle of straight elongated elements, it will be appreciated that the elements could be curved longitudinally, or with appropriate modification of the wrapping machine in the form of closed loops. Similarly single elements rather than bundles may be wrapped in the same way and where appropriate such single elements or bundles of elements may be enclosed in an inner wrapper of any suitable kind, e.g. an elongated cardboard carton or box or similar wrapping as mentioned above.

However, in all cases the package is provided with a wrapping consisting of overlapping turns of a wrapping material and tear member which extends across adjacent turns of the wrapping material over substantially the entire length of the package.

Whilst the invention is intended primarily for use in connection with elongate articles, that is to say articles having one dimension that is substantially greater than other dimensions, it will be understood that the invention may be employed for wrapping articles of which all the dimensions are generally similar so that there is no predominant longitudinal dimension. Thus a package of generally cubic form could be wrapped in a similar manner, if necessary by carrying out two successive wrapping operations and turning the article through 90° between such operations so as to form a first wrapping around four contiguous faces and a second wrapping around two of the previously wrapped faces and the two remaining faces.

I claim:

1. A method of wrapping an elongate article by forming a winding thereon of at least one strip of flexible wrapping material which has a transverse width that is narrow compared with the length of said article and is wound helically around said article so that successive turns of the wrapping material overlap one another along the length of the article wherein the tear member is applied to the article simultaneously with the wrapping process by passing the article successively through a station at which the tear member is applied and a station at which the wrapping is applied, thereby forming a package comprising said elongate article and said wrapping material, including the step of laying between the wrapping material and the elongate article a longitudinally extending tear member which extends over substantially the entire length of the article and in contact with successive turns of the wrapping material with an end portion of the tear member exposed externally of the package and thereby available to be pulled in a direction away from the elongate article so as thereby to tear through the successive turns of the wrapping material and along substantially the entire length of the elongate article, wherein the tear member comprises a narrow strip of appropriate material having two opposed faces and an adhesive substance on at least one of said faces thereof whereby the tear member becomes attached relative to said elongate article so as to restrain it against lengthwise withdrawal from the package when opening is attempted and wherein said adhesive-coated tear member is applied by means of a pressure roller so that as the article is advanced towards the wrapping station, the tear strip is drawn off from a supply thereof by virtue of advancement of the article during the wrapping process.

2. A method according to claim 1 wherein the elongate article has an outer face and the tear member is attached to the outer face of the article being wrapped.

3. A method according to claim 1 wherein the wrapping material has an inner face and the tear member is attached to the inner face of the wrapping material.

4. A package comprising an article having thereon a wrapping formed in accordance with the method as claimed in claim 1.

5. A method of wrapping an elongate article by forming a winding thereon of at least one strip of flexible wrapping material which has a transverse width that is narrow compared with the length of said article and is wound helically around said article so that successive turns of the wrapping material overlap one another along the length of the article wherein the tear member is applied to the article simultaneously with the wrapping process by passing the article successively through a station at which the tear member is applied and a station at which the wrapping is applied, thereby forming a package comprising said elongate article and said wrapping material, including the step of laying between the wrapping material and the elongate article a longitudinally extending tear member which extends over substantially the entire length of the article and in contact with successive turns of the wrapping material with an end portion of the tear member exposed externally of the package and thereby available to be pulled in a direction away from the elongate article so as thereby to tear through the successive turns of the wrapping material and along substantially the entire length of the elongate article, wherein the tear member comprises a narrow strip of appropriate material having two opposed faces and an adhesive substance on at least one of said faces thereof whereby the tear member becomes attached relative to said elongate article so as to restrain it against lengthwise withdrawal from the package when opening is attempted and wherein such adhesive-coated tear strip is applied to the article being wrapped with the adhesive-coated face outermost, an initial length of the strip being laid on the leading end of the article as it approaches the wrapping station, so that such initial length of tear strip becomes secured to the inner face of at least the first turn of wrapping material applied to the article, whereby the tear strip can be drawn onto the remainder of the article as it progresses through the wrapping station.

6. A method according to claim 5 wherein the elongate article has an outer face and the tear member is attached to the outer face of the article being wrapped.

7. A method according to claim 5 wherein the wrapping material has an inner face and the tear member is attached to the inner face of the wrapping material.

8. A package comprising an article having thereon a wrapping formed in accordance with the method as claimed in claim 5.

* * * * *